US008862042B2

(12) United States Patent
Sakamoto et al.

(10) Patent No.: US 8,862,042 B2
(45) Date of Patent: Oct. 14, 2014

(54) GLOSSING DEVICE

(71) Applicant: Konica Minolta, Inc., Tokyo (JP)

(72) Inventors: Sadaaki Sakamoto, Tokyo (JP); Go Yamaguchi, Tokyo (JP); Akihiro Honya, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 55 days.

(21) Appl. No.: 13/886,402

(22) Filed: May 3, 2013

(65) Prior Publication Data

US 2013/0302076 A1 Nov. 14, 2013

(30) Foreign Application Priority Data

May 8, 2012 (JP) ..... 2012-106529

(51) Int. Cl.
*G03G 15/20* (2006.01)
*G03G 8/00* (2006.01)
*G03G 21/00* (2006.01)

(52) U.S. Cl.
CPC ..... *G03G 8/00* (2013.01); *G03G 2215/00805* (2013.01); *G03G 21/00* (2013.01)
USPC ..... 399/341; 399/407

(58) Field of Classification Search
USPC ..... 399/341
See application file for complete search history.

(56) References Cited

U.S. PATENT DOCUMENTS

| | | | | |
|---|---|---|---|---|
| 7,995,959 | B2 * | 8/2011 | Nakamura et al. | 399/341 |
| 2012/0301190 | A1 * | 11/2012 | Tanaka | 399/297 |
| 2013/0149541 | A1 * | 6/2013 | Sakamoto et al. | 428/411.1 |
| 2013/0302070 | A1 * | 11/2013 | Oosaku et al. | 399/286 |

FOREIGN PATENT DOCUMENTS

| | | | |
|---|---|---|---|
| JP | 2002-341619 | A | 11/2002 |
| JP | 2010-253925 | A | 11/2010 |
| JP | 2011-73326 | A | 4/2011 |
| JP | 2011-81136 | A | 4/2011 |

* cited by examiner

*Primary Examiner* — Clayton E Laballe
*Assistant Examiner* — Leon W Rhodes, Jr.
(74) *Attorney, Agent, or Firm* — Lucas & Mercanti, LLP

(57) ABSTRACT

Disclosed is a glossing device with a cooling and separating belt which has a high wear resistance and is allowed to maintain the initial surface property over a long period of time. In the glossing device, the cooling and separating belt has a front surface formed of a cured resin containing a structural unit derived from urethane(meth)acrylate (A) having three or more (meth)acryloyloxy groups per molecule, a structural unit derived from a polyfunctional monomer (B) having three or more (meth)acryloyloxy groups per molecule and no urethane bond, and a structural unit derived from fluorine-modified acrylate (C). The cured resin contains 18 to 63% by mass of the structural unit derived from the urethane(meth)acrylate (A), 18 to 63% by mass of the structural unit derived from the polyfunctional monomer (B), and 10 to 40% by mass of the structural unit derived from the fluorine-modified acrylate (C).

5 Claims, 2 Drawing Sheets

GLOSSING DEVICE

CROSS REFERENCE TO RELATED APPLICATION

This Application claims the priority of Japanese Patent Application No. 2012-106529 filed on May 8, 2012, which application is incorporated herein by reference in its entirety.

TECHNICAL FIELD

The present invention relates to a glossing device with a cooling and separating belt.

BACKGROUND ART

A process of glossing an image formed by an electrophotographic image-forming method includes those utilizing a cooling and separating belt.

Specifically, the process utilizes a fixing device or a glossing device equipped with an endless cooling and separating belt, a pressure roller, and a cooling mechanism. In the fixing device or glossing device, the endless cooling and separating belt has a smooth face and is wound around a heating roller and a supporting roller so that the smooth face becomes an outer peripheral surface. The pressure roller is disposed to press the cooling and separating belt onto the heating roller, thereby forming a nip portion between the cooling and separating belt and the pressure roller. The cooling mechanism is disposed at the downstream of the heating roller in the traveling direction of the cooling and separating belt. In the process of utilizing the device, a toner layer formed on an image support such as paper is heated and then cooled while the toner layer is in close contact with the smooth face of the cooling and separating belt. Finally, the image support is separated from the cooling and separating belt. (See, for example, Patent Literatures 1 to 4.)

A cooling and separating belt used in such a process is required to have a low surface energy so that a foreign substance is prevented from adhering to the front surface of the cooling and separating belt when the image support is separated. Further, the cooling and separating belt is required to have wear resistance to stresses due to friction and separation, and a long lifetime.

CITATION LIST

Patent Literature

Patent Literature 1: Japanese Patent Application Laid-Open No. 2011-081136

Patent Literature 2: Japanese Patent Application Laid-Open No. 2011-073326

Patent Literature 3: Japanese Patent Application Laid-Open No. 2010-253925

Patent Literature 4: Japanese Patent Application Laid-Open No. 2002-341619

SUMMARY OF INVENTION

Technical Problem

In order to achieve a low energy property (releasability) of a cooling and separating belt, the surface of the cooling and separating belt has been coated with a low-energy component such as F and Si. However, it is difficult that the initial surface property is maintained. This is because the low-energy component is oriented to the surface, and therefore the surface of the cooling and separating belt is scraped off by stresses due to friction and separation, that is, the low-energy component is scraped off in an early stage.

The present invention has been made on the basis of the foregoing circumstances and has as its object the provision of a glossing device with a cooling and separating belt which has a high wear resistance and is allowed to maintain the initial surface property over a long period of time.

Solution to Problem

The present inventors have studied, and as a result, found that a cooling and separating belt having a front surface formed of a cured resin having certain types of structural units in a specific ratio exerts a high wear resistance. Thus, the present invention has been completed.

The glossing device of the present invention has an endless cooling and separating belt which is wound around a heating roller and a supporting roller, a pressure roller disposed so as to press the cooling and separating belt onto the heating roller to form a nip portion between the cooling and separating belt and the pressure roller, and a cooling mechanism disposed at a downstream of the heating roller in a traveling direction of the cooling and separating belt. In the glossing device, the cooling and separating belt has a front surface formed of a cured resin containing a structural unit derived from urethane (meth)acrylate (A) having three or more (meth)acryloyloxy groups per molecule, a structural unit derived from a polyfunctional monomer (B) having three or more (meth)acryloyloxy groups per molecule and no urethane bond, and a structural unit derived from fluorine-modified acrylate (C). Further, the cured resin contains 18 to 63% by mass of the structural unit derived from the urethane(meth)acrylate (A), 18 to 63% by mass of the structural unit derived from the polyfunctional monomer (B), and 10 to 40% by mass of the structural unit derived from the fluorine-modified acrylate (C).

Although the (meth)acryloyloxy group represents a combination of an acryloyloxy group ($CH_2{=}C(O)O{-}$) and a methacryloyloxy group ($CH_2{=}C(CH_3)C(O)O{-}$), it means at least one of the acryloyloxy group and the methacryloyloxy group.

In the glossing device of the present invention, the urethane (meth)acrylate (A) may preferably be obtained by reaction of a polyol compound (a1) having two or more hydroxyl groups per molecule, a polyisocyanate compound (a2), and an acrylate compound (a3) having a hydroxyl group and an acryloyloxy group per molecule.

Further in the glossing device of the present invention, the polyol compound (a1) may preferably be a cyclic alcohol.

Moreover in the glossing device of the present invention, the fluorine-modified acrylate (C) may preferably have a number average molecular weight of 10,000 or higher.

In the glossing device of the present invention, the cooling and separating belt may preferably have a surface layer formed of the cured resin on a substrate of endless belt formed of a polyimide resin.

Advantageous Effects of Invention

In the glossing device of the present invention, the cooling and separating belt has a front surface formed of a cured resin containing a specific structural unit derived from urethane (meth)acrylate (A), a specific structural unit derived from a polyfunctional monomer (B), and a specific structural unit derived from fluorine-modified acrylate (C) in a specific ratio.

Therefore, the balance of elasticity derived from the urethane (meth)acrylate (A) and hardness derived from the polyfunctional monomer (B) is excellent in the cooling and separating belt and high toughness can be exerted. Thus, the wear resistance to stresses due to friction and separation can be obtained. Even when the belt is used for extended periods, the low energy property derived from the fluorine-modified acrylate (C) is not largely impaired. Accordingly, the initial surface property can be maintained over a long period of time.

DESCRIPTION OF EMBODIMENTS

Figure 1:
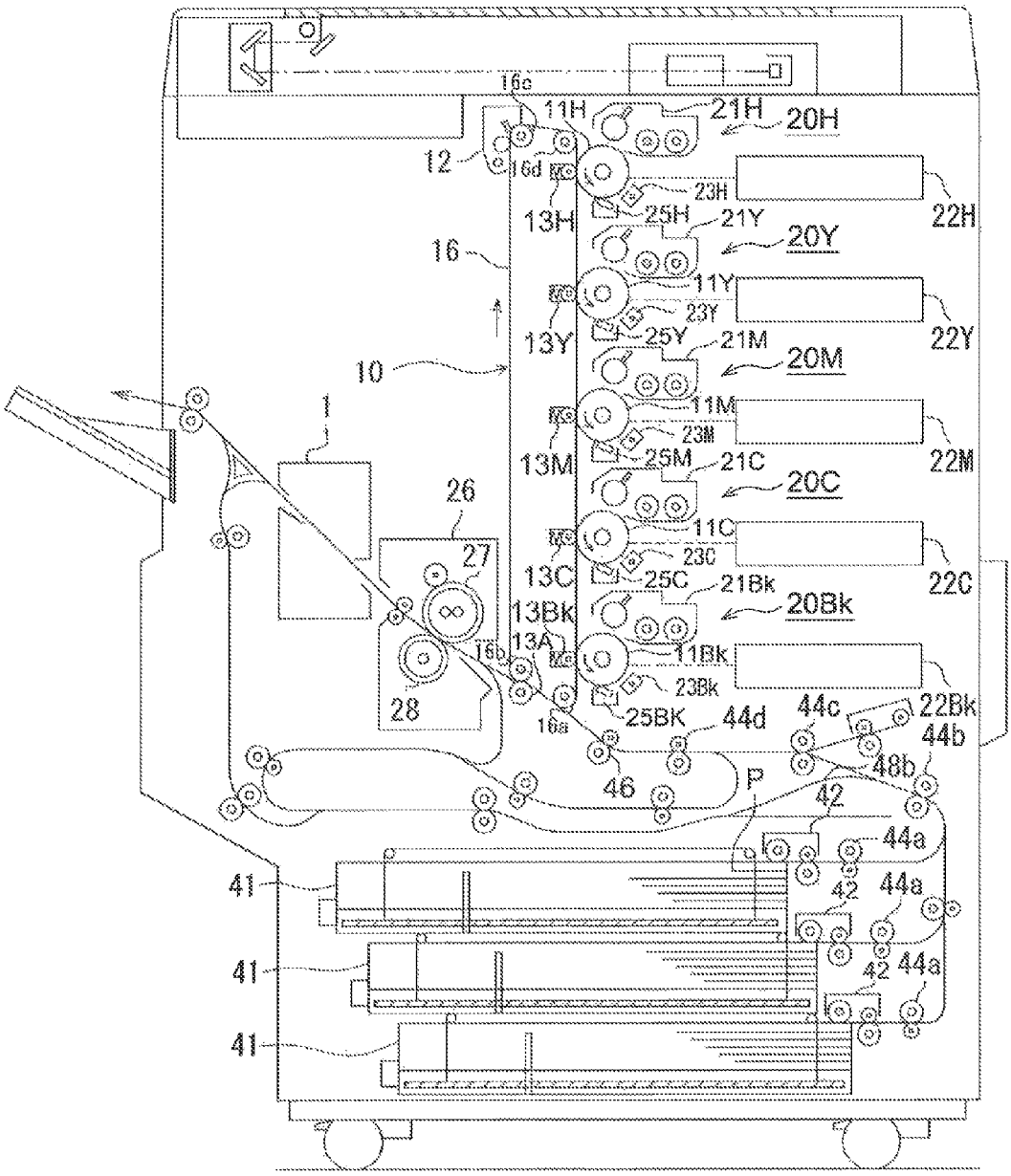
FIG. 1 is a cross-sectional view illustrating one example of the configuration of an image-forming device equipped with a glossing device of the present invention.

Hereinafter, the present invention will be specifically described.

The cooling and separating belt constituting the glossing device of the present invention is installed in a glossing device 1 described below (see FIG. 2). In the glossing device, the cooling and separating belt has a front surface formed of a specific cured resin containing a structural unit derived from urethane(meth)acrylate (A) having three or more (meth)acryloyloxy groups per molecule, a structural unit derived from a polyfunctional monomer (B) having three or more (meth) acryloyloxy groups per molecule and no urethane bond, and a structural unit derived from fluorine-modified acrylate (C) in a specific ratio.

Urethane(meth)acrylate (A):

Urethane(meth)acrylate (A) is not particularly limited as long as it is a compound having a urethane bond and three or more (meth)acryloyloxy groups per molecule.

As examples of the urethane(meth)acrylate (A), may be mentioned a compound having a urethane bond in a main chain and three or more (meth)acryloyloxy groups bonded to the terminal of the main chain or a side chain.

Specific examples of the urethane(meth)acrylate (A) may include a product of reaction of a polyol compound (a1) having two or more hydroxyl groups per molecule, a polyisocyanate compound (a2), and an acrylate compound (a3) having a hydroxyl group and an acryloyloxy group per molecule; and a product of reaction of a polyisocyanate compound (a2) and an acrylate compound (a3) having a hydroxyl group and an acryloyloxy group per molecule.

The product of reaction of a polyol compound (a1), a polyisocyanate compound (a2), and an acrylate compound (a3) can be obtained by reacting a polyol compound (a1) with a polyisocyanate compound (a2) to produce a so-called urethane prepolymer having an isocyanate group, followed by reaction with an acrylate compound (a3).

Specifically, a polyol compound (a1) is reacted with a polyisocyanate compound (a2) in such a composition that the amount of isocyanate group is excess to produce a urethane prepolymer, similarly to the typical synthesis of urethane prepolymer. Further, the ratio (equivalent ratio) of an isocyanate group to a hydroxyl group in the reaction is preferably 1.2 to 2.5, more preferably 1.5 to 2.2.

Subsequently, the isocyanate group of the obtained urethane prepolymer is reacted with the hydroxyl group of an acrylate compound (a3) to produce urethane(meth)acrylate (A).

On the other hand, the product of reaction of a polyisocyanate compound (a2) and an acrylate compound (a3) can be obtained by reacting the isocyanate group of the polyisocyanate compound (a2) with the hydroxyl group of the acrylate compound (a3).

Polyol Compound (a1):

The polyol compound (a1) is not particularly limited as long as it has two or more hydroxyl groups per molecule.

Examples of the polyol compound may include a high-molecular polyol such as polyetherpolyol and polyesterpolyol; and a low-molecular polyol such as triethyleneglycol and 1,6-hexanediol. These polyol compounds may be used either singly or in any combination thereof.

As the polyol compound (a1), a polyol having a molecular weight of 500 or lower may be suitably used since it has excellent curability and the degree of hardness of the specific surface layer to be obtained is improved. In particular, a low molecular polyol having a skeleton of cycloaliphatic hydrocarbon, that is, a low-molecular cyclic alcohol may be suitably used since the degree of hardness of the specific surface layer to be obtained is further improved.

Specific examples of the low-molecular cyclic alcohol may include 1,4-cyclohexanediol and tricyclodecanedimethanol.

Polyisocyanate Compound (a2):

The polyisocyanate compound (a2) is not particularly limited as long as it has two or more isocyanate groups per molecule.

Specific examples of the polyisocyanate compound may include aromatic polyisocyanate such as TDI (for example, 2,4-tolylene diisocyanate (2,4-TDI) and 2,6-tolylene diisocyanate (2,6-TDI)), MDI (for example, 4,4'-diphenylmethane diisocyanate (4,4'-MDI) and 2,4'-diphenylmethane diisocyanate (2,4'-MDI)), 1,4-phenylene diisocyanate, polymethylenepolyphenylene polyisocyanate, xylylene diisocyanate (XDI), tetramethylxylylene diisocyanate (TMXDI), tolidine diisocyanate (TODI), 1,5-naphthylene diisocyanate (NDI), and triphenylmethane triisocyanate; aliphatic polyisocyanate such as hexamethylene diisocyanate (HDI), trimethylhexamethylene diisocyanate (TMHDI), lysine diisocyanate, and norbornane diisocyanate (NBDI); alicyclic polyisocyanate such as trans-cyclohexane-1,4-diisocyanate, isophorone diisocyanate (IPDI), bis(isocyanatomethyl)cyclohexane ($H_6XDI$), and dicyclohexylmethane diisocyanate ($H_{12}MDI$); carbodiimide-modified polyisocyanate thereof; and isocyanurate-modified polyisocyanate thereof.

Among them, tolylene diisocyanate (TDI) may be preferably used since the viscosity of the specific polymerizable composition described below can be decreased to achieve good application property (workability).

These polyisocyanate compounds may be used either singly or in any combination thereof.

Acrylate Compound (a3):

The acrylate compound (a3) is not particularly limited as long as it has a hydroxyl group and an acryloyloxy group per molecule.

As the acrylate compound (a3), a polyfunctional acrylate compound having two or more acryloyloxy groups may be preferably used since urethane(meth)acrylate (A) having three or more acryloyloxy groups can be obtained.

Specific examples of such a polyfunctional acrylate compound may include trimethylolpropane diacrylate, pentaglycerol diacrylate, pentaerythritol triacrylate, dipentaerythritol triacrylate, and dipentaerythritol tetracrylate.

In the specific cured resin according to the present invention, the content of the structural unit derived from urethane (meth)acrylate (A) is 18 to 63% by mass, preferably 40 to 55% by mass.

When the content of the structural unit derived from urethane(meth)acrylate (A) in the specific cured resin falls within the above-described range, the specific surface layer has sufficient toughness, and excellent wear resistance is achieved. When the content of the structural unit derived from urethane(meth)acrylate (A) is less than 18% by mass, the toughness of surface layer obtained is insufficient, and the belt is brittle. Therefore, the wear resistance cannot be sufficiently achieved. On the other hand, when it exceeds 63% by mass, the surface layer obtained cannot have a sufficient degree of hardness. Therefore, the wear resistance is low.

Polyfunctional Monomer (B):

The polyfunctional monomer (B) is not particularly limited as long as it is a compound having three or more (meth) acryloyloxy groups per molecule and no urethane bond, that is, a compound having three or more (meth)acryloyloxy groups per molecule except for urethane(meth)acrylate (A) described above.

Specific examples of the polyfunctional monomer having three (meth)acryloyloxy groups per molecule may include trimethylolpropane tri(meth)acrylate, pentaerythritol tri (meth)acrylate, and dipentaerythritol tri(meth)acrylate.

Specific examples of the polyfunctional monomer having four (meth)acryloyloxy groups per molecule may include pentaerythritol tetra(meth)acrylate, dipentaerythritol tetra (meth)acrylate, and tripentaerythritol tetra(meth)acrylate.

Specific examples of the polyfunctional monomer having five or more (meth)acryloyloxy groups per molecule may include dipentaerythritol penta(meth)acrylate, dipentaerythritol hexa(meth)acrylate, tripentaerythritol penta(meth)acrylate, tripentaerythritol hexa(meth)acrylate, tripentaerythritol hepta(meth)acrylate, and tripentaerythritol octa(meth)acrylate.

Among them, a polyfunctional monomer having three (meth)acryloyloxy groups per molecule is preferable, and a polyfunctional monomer having three acryloyloxy groups per molecule is more preferable. This is because the viscosity of the specific polymerizable composition described below can be decreased and the adhesion of the specific surface layer formed of the specific polymerizable composition to the substrate of the belt is improved.

Trimethylolpropane triacrylate, pentaerythritol tetraacrylate, dipentaerythritol tetra(meth)acrylate, or a compound represented by a formula (b1) described blow is preferably used. This is because the degree of hardness of the specific surface layer and the adhesion to the substrate of the belt are increased and the rapid curability, water resistance, solvent resistance, and chemical resistance are excellent.

Since the curability is excellent and the degree of hardness of the specific surface layer is further increased, the compound represented by the following formula (b1) is more preferably used.

These polyfunctional monomers (B1) may be used either singly or in any combination thereof.

formula (b1)

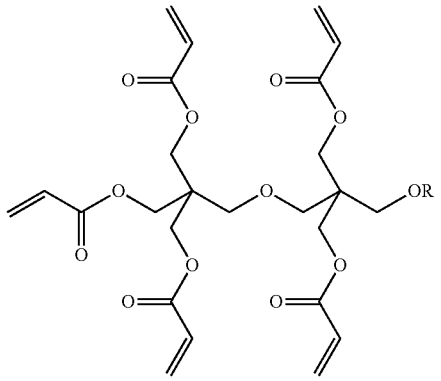

(wherein R represents a hydrogen atom or a (meth)acryloyl group.)

In the specific cured resin according to the present invention, the content of the structural unit derived from the polyfunctional monomer (B) is 18 to 63% by mass, preferably 30 to 40% by mass.

When the content of the structural unit derived from the polyfunctional monomer (B) in the specific cured resin falls within the above-described range, the specific surface layer has an appropriate degree of hardness and sufficient adhesion to the substrate of the belt. When the content of the structural unit derived from the polyfunctional monomer (B) is less than 18% by mass, the surface layer obtained cannot have a sufficient degree of hardness. Therefore, the wear resistance is low. On the other hand, when it exceeds 63% by mass, the resulting surface layer is brittle. Therefore, the wear resistance cannot be sufficiently achieved.

Fluorine-Modified Acrylate (C):

Examples of the fluorine-modified acrylate (C) may include a compound obtained by copolymerization of one or more types of each component to be combined with a fluorine-modified acrylate-based resin, for example, a fluorinated olefin monomer such as tetrafluoroethylene, vinylidene fluoride, hexafluoropropylene, and fluoride vinyl ether, and a typical acrylate monomer including alkyl esters such as methyl, ethyl, butyl, octyl, and dodecyl esters of acrylic acid or methacrylic acid; hydroxyalkyl esters such as hydroxyethyl and hydroxybutyl esters of acrylic acid or methacrylic acid; and glyceryl esters.

As the fluorine-modified acrylate (C), a compound having a number average molecular weight of 10,000 or higher, for example, a copolymer using tetrafluoroethylene and hexafluoropropylene as fluorinated olefin monomers is preferably used. In this case, F as a low-energy component can be introduced to a certain depth from the outermost surface. Therefore, even when the outermost surface is worn, the initial performance can be exerted.

In the specific cured resin according to the present invention, the content of the structural unit derived from the fluorine-modified acrylate (C) is 10 to 40% by mass, preferably 20 to 30% by mass.

When the content of the structural unit derived from the fluorine-modified acrylate (C) in the specific cured resin falls within the above-described range, the specific surface layer has sufficient releasability. When the content of the structural unit derived from the fluorine-modified acrylate (C) is less than 10% by mass, the specific surface layer cannot have sufficient releasability. On the other hand, when it exceeds 40% by mass, the surface layer obtained cannot have sufficient degree of hardness and toughness. Therefore, the wear resistance cannot be sufficiently achieved. Further, the application property of the specific polymerizable composition described below is low. Therefore, the specific surface layer may not be formed.

In a cooling and separating belt 2 according to the present invention (see FIG. 2), the specific surface layer formed of the specific cured resin as described above can be formed on a substrate of an endless belt.

The substrate of the belt can be formed of a polyimide resin, a poly(methyl methacrylate) resin, a polycarbonate resin, a polystyrene resin, an acrylonitrile-styrene copolymer resin, a polyvinyl chloride resin, an acetate resin, an ABS resin, a polyester resin, or a polyamide resin. A substrate formed of a polyimide resin is preferably used as the substrate of the belt.

It is preferable that the thickness of the surface layer of the cooling and separating belt 2 is 1 to 30 μm. When the thickness of the surface layer is less than 1 μm, an effect of preventing the surface degradation of the substrate of the belt cannot be sufficiently obtained. On the other hand, when it exceeds 30 μm, adhesion to the substrate of the belt cannot be sufficiently obtained, and therefore cracking may occur.

As the example of the production process of the cooling and separating belt 2 according to the present invention, may be mentioned a process including applying the specific polymerizable composition containing a polymerizable component containing urethane(meth)acrylate (A), a polyfunctional monomer (B), and a fluorine-modified acrylate (C), which form the above-described specific cured resin, a polymerization initiator (D), and if necessary, another component such as a solvent to the substrate of the belt to form a coating film, and exposing the film to light to cure the film.

Polymerization Initiator (D):

The polymerization initiator (D) contained in the specific polymerizable composition is not particularly limited as long as it is one that can initiate polymerization of urethane(meth) acrylate (A), a polyfunctional monomer (B), and a fluorine-modified acrylate (C) by light or heat.

As the polymerization initiator (D), a photopolymerization initiator can be adopted. Examples thereof may include an acetophenone compound, a benzoin ether compound, a benzophenone compound, a sulfur-containing compound, an azo compound, a peroxide compound, and a phosphine oxide compound.

Specific examples thereof may include a carbonyl compound such as benzoin, benzoin methyl ether, benzoin ethyl ether, benzoin isopropyl ether, acetoin, butyroin, toluoin, benzyl, benzophenone, p-methoxybenzophenone, diethoxy acetophenone, α,α-dimethoxy-α-phenylacetophenone, methylphenyl glyoxylate, ethylphenyl glyoxylate, 4,4'-bis (dimethylaminobenzophenone), 2-hydroxy-2-methyl-1-phenylpropan-1-one, 2,2-dimethoxy-1,2-diphenylethan-1-one, and 1-hydroxycyclohexyl phenyl ketone; a sulfur-containing compound such as tetramethylthiuram monosulfide and tetramethylthiuram disulfide; an azo compound such as azobisisobutyronitrile and azobis-2,4-dimethylvaleronitrile; and a peroxide compound such as benzoyl peroxide and di-tert-butyl peroxide. These initiators may be used either singly or in any combination thereof.

From the viewpoint of photostability, high efficiency of photocleavage, surface curability, compatibility to the specific cured resin, low volatility, and low odor, 1-hydroxycyclohexyl phenyl ketone, 2-hydroxy-2-methyl-1-phenylpropan-1-one, or 1-[4-(2-hydroxyethoxy)-phenyl]-2-hydroxy-2-methyl-1-propan-1-one is preferably used.

The content of the photopolymerization initiator (D) in the specific polymerizable composition is preferably 1 to 10% by mass. Since the curability is excellent, the degree of hardness of the specific surface layer is sufficiently obtained, and the adhesion to the substrate of the belt is high, the content of the initiator (D) is more preferably 2 to 8% by mass, further preferably 3 to 6% by mass.

The specific polymerizable composition preferably contains a solvent since the application property (workability) is good.

Specific examples of the solvent may include ethanol, isopropanol, butanol, toluene, xylene, acetone, methyl ethyl ketone, ethyl acetate, and butyl acetate.

Within a range not impairing the object of the present invention, the polymerizable composition may contain various additives, for example, another component such as a filler, an age resistor, an antistatic agent, a flame retardant, an adhesion imparting agent, a dispersant, an antioxidant, an antifoam, a leveling agent, a flatting agent, a photostabilizer (for example, hindered amine compounds), a dye, and a pigment.

Specific examples of the filler may include pyrophyllite clay, kaolin clay, and calcined clay; fumed silica, calcined silica, precipitated silica, pulverized silica, and melted silica; diatomaceous earth; iron oxide, zinc oxide, titanium oxide, barium oxide, and magnesium oxide; calcium carbonate, magnesium carbonate, and zinc carbonate; an organic or inorganic filler such as carbon black; a fatty acid, a rosin acid, a fatty acid ester-treated product, and a fatty acid ester urethane compound-treated product thereof.

Specific examples of the age resistor may include a hindered phenol-based compound and a hindered amine-based compound.

Specific examples of the antioxidant may include butylhydroxytoluene (BHT) and butylhydroxyanisole (BHA).

Specific examples of the antistatic agent may include a quaternary ammonium salt; and a hydrophillic compound such as polyglycol and an ethylene oxide derivative.

Specific examples of the flame retardant may include chloroalkyl phosphate, dimethyl methylphosphonate, a bromine-phosphorus compound, ammonium polyphosphate, neopentylbromide-polyether, and brominated polyether.

Specific examples of the adhesion imparting agent may include a terpene resin, a phenolic resin, a terpene-phenolic resin, a rosin resin, a xylene resin, and an epoxy resin.

Specific examples of the leveling agent may include a silicone-based leveling agent, an acrylic leveling agent, a vinyl-based leveling agent, and a fluorine-containing leveling agent.

The specific polymerizable composition can be prepared, for example, by sufficiently stirring the respective essential components and any components under reduced pressure with a stirrer such as a mixer.

A process of applying the specific polymerizable composition to the substrate of the belt is not particularly limited, and a known coating process such as a brush coating process, a flow coating process, a dip coating process, a spray coating process, or a spin-coating process may be adopted.

The amount of the specific polymerizable composition applied may be adjusted so that the obtained specific surface layer has an intended thickness.

Examples of the process of curing the specific polymerizable composition may include a process of applying heat and a process of irradiating it with light such as ultraviolet light.

When the specific polymerizable composition is cured by heat, the heating temperature is 80 to 120° C.

When the specific polymerizable composition is cured by ultraviolet irradiation, the amount of irradiated ultraviolet light is preferably 500 to 3,000 mJ/cm$^2$ from the viewpoint of rapid curability and workability.

When the specific polymerizable composition is cured by ultraviolet irradiation, the temperature is preferably 20 to 80° C.

A device for ultraviolet irradiation is not especially limited, and a conventionally known device may be adopted.

In the coating film prepared by applying the specific polymerizable composition, the solvent is removed by drying.

The coating film may be dried before, after, during polymerization of polymerizable component, or any combination thereof. Specifically, it is preferable that the coating film is first dried until the fluidity of the film disappears, the polymerizable component is polymerized, and the coating film is secondarily dried so that the amount of a volatile substance in the protective layer is a specified amount.

A process of drying a coating film can be appropriately selected depending on the type of solvent and the thickness of a protective layer to be formed. For example, the drying temperature is preferably 40 to 100° C., more preferably about 60° C. Further, the drying time is preferably 1 to 5 minutes, more preferably about 3 minutes.

The cooling and separating belt 2 is installed in the glossing device 1 which glosses an image formed by an electrophotographic image-forming method.

Hereinafter, an electrophotographic image-forming device equipped with the glossing device 1 and a process of glossing an image by the image-forming device will be described.

FIG. 1 is a cross-sectional view illustrating one example of the configuration of an image-forming device equipped with the glossing device of the present invention.

The image-forming device is a tandem-type color image forming device which can continuously conduct image formation and glossing of a toner layer.

The image forming device has a clear toner image forming section 20H for forming a clear toner image as the top layer of toner layer which is subjected to glossing and comes in direct contact with a cooling and separating belt 2; color toner image forming sections 20Y, 20M, 20C, and 20Bk for forming yellow, magenta, cyan, and black toner images, respectively; an intermediate transfer section 10 for transferring the toner images formed in the clear toner image forming section 20H and the color toner image forming sections 20Y, 20M, 20C, and 20Bk to an image support P; a fixing device 26 for conducting fixing treatment in which pressure is applied to the image support P under heating and the toner images are fixed to obtain a toner layer; and a glossing device 1 for smoothing the surface of the toner layer.

In the color toner image forming section 20Y, a yellow toner image is formed. In the color toner image forming section 20M, a magenta toner image is formed. In the color toner image forming section 20C, a cyan toner image is formed. In the color toner image forming section 20Bk, a black toner image is formed.

The clear toner image forming section 20H has a photoreceptor 11H that is an electrostatic latent image carrying body; a charging unit 23H for electrically charging the surface of the photoreceptor 11H to a uniform electric potential; an exposing unit 22H for forming an electrostatic latent image of a desired shape on the photoreceptor 11H uniformly charged; a development unit 21H for conveying a clear toner onto the photoreceptor 11H to visualize the electrostatic latent image; and a cleaning unit 25H for collecting a residual toner on the photoreceptor 11H after primary transfer.

The color toner image forming sections 20Y, 20M, 20C, and 20Bk have photoreceptors 11Y, 11M, 11C, and 11Bk that are each an electrostatic latent image carrying body; charging units 23Y, 23M, 23C, and 23Bk for electrically charging the surfaces of the photoreceptors 11Y, 11M, 11C, and 11Bk to the uniform electric potential, respectively; exposing units 22Y, 22M, 22C, and 22Bk for forming an electrostatic latent image of the desired shape on the respective photoreceptors 11Y, 11M, 11C, and 11Bk uniformly charged; development units 21Y, 21M, 21C, and 21Bk for conveying color toners onto the photoreceptors 11Y, 11M, 11C, and 11Bk, respectively, to visualize the electrostatic latent images; and cleaning units 25Y, 25M, 25C, and 25Bk for collecting respective residual toners on the photoreceptors 11Y, 11M, 11C, and 11Bk after primary transfer.

The intermediate transfer section 10 has an intermediate transfer belt 16; a primary transfer roller 13H for transferring the clear toner image formed by the clear toner image forming section 20H to the intermediate transfer belt 16; primary transfer rollers 13Y, 13M, 13C, and 13Bk for transferring the color toner images formed by the color toner image forming sections 20Y, 20M, 20C, and 20Bk to the intermediate transfer belt 16; a secondary transfer roller 13A for transferring the clear toner image transferred to the intermediate transfer belt 16 by the primary transfer roller 13H and the color toner images transferred to the intermediate transfer belt 16 by the primary transfer rollers 13Y, 13M, 13C, and 13Bk to the image support P; and a cleaning unit 12 for collecting a residual toner on the intermediate transfer belt 16.

The intermediate transfer belt 16 is an endless belt which is wound around and rotatably supported by a plurality of supporting rollers 16*a* to 16*d*.

The fixing device 26 is provided so that a pair of heating and pressure rollers 27 and 28 are pressed against each other and a nip portion is formed in the pressing part.

The image formation processing in the image forming device shown in FIG. 1 will be described in detail below.

Glossing Device:

The glossing device 1 can successively conduct the steps of heating and pressure an object to be processed W which has a toner layer formed on an image support P, cooling the object, and separating the object from the cooling and separating belt 2.

Figure 2:
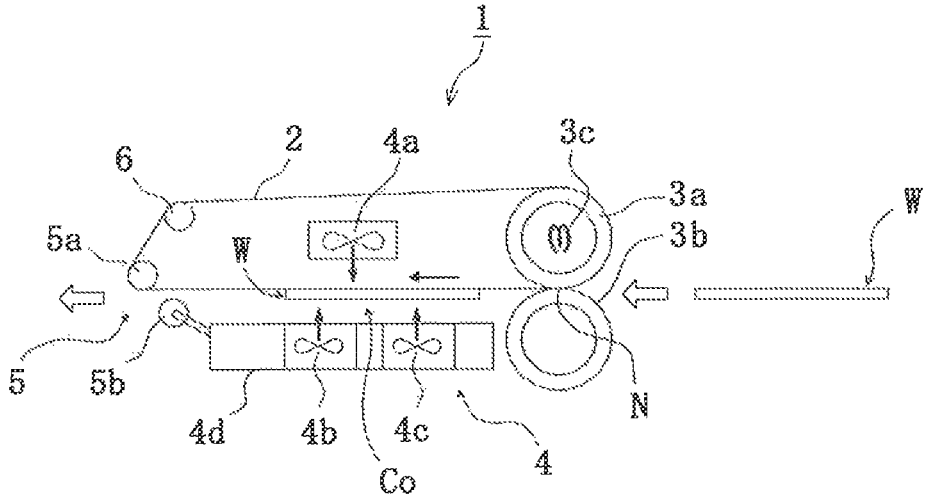
FIG. 2 is a cross-sectional view illustrating one example of the configuration of the glossing device of the present invention.

As shown in FIG. 2, the glossing device 1 is specifically equipped with a heating roller 3*a* rotating at a constant velocity; an endless cooling and separating belt 2 which has a smooth face and is wound around the heating roller 3*a*, a separating roller 5*a*, and a supporting roller 6 so that the smooth face is an outer peripheral surface; and a pressure roller 3*b* disposed so that the cooling and separating belt 2 is pressed onto the heating roller 3*a* to form a nip portion N between the cooling and separating belt 2 and the pressure roller 3*b*. The glossing device 1 further has a cooling mechanism 4 disposed at the downstream of the heating roller 3*a* in the traveling direction of the cooling and separating belt 2 and at the upstream of the separating roller 5*a*; and a separating mechanism 5 disposed near the separating roller 5*a* at the downstream of the cooling mechanism 4.

The cooling and separating belt 2 has the specific surface layer formed of the cured resin according to the present invention on the outer peripheral surface of substrate of the belt. Further, the front surface of the specific surface layer is smooth.

The substrate constituting the cooling and separating belt 2 is suitably formed of polyimide or polyethylene terephthalate (PET). The substrate may be a seamless belt or a belt-like product processed by splicing sheet-like films.

For example, the thickness of the specific surface layer of the cooling and separating belt 2 is preferably 1 to 30 μm, more preferably 2 to 10 μm.

The heating roller 3*a* and the pressure roller 3*b* are disposed so that both the rollers are pressed against each other via the cooling and separating belt 2. Specifically, a silicone rubber layer or a fluororubber layer is disposed on the front surface of one or both of the heating roller 3*a* and the pressure roller 3*b*. From the configuration, a glossy nip portion N is formed in a part pressed by the heating roller 3*a* and the pressure roller 3*b*. It is preferable that the width of the glossy nip portion N falls within a range of about 1 mm to about 8 mm.

As the heating roller 3*a*, a roller in which the surface of a substrate made of metal such as aluminum is coated with an elastic layer made of silicone rubber, or the like, and has a predetermined outer diameter may be adopted. The heating roller 3*a* has a halogen lamp of 300 to 350 W in the inside thereof as a heating source 3*c*, and is configured to heat the inside thereof so that the surface temperature thereof is a predetermined temperature.

As the pressure roller 3*b*, a roller in which the surface of a substrate made of metal such as aluminum is coated with an elastic layer made of silicone rubber, or the like, and then with a release layer of a tube made of a tetrafluoroethylene-perfluoroalkyl vinyl ether copolymer (PFA), and has a predetermined outer diameter may be adopted. The pressure roller 3*b* does not have a heat source. The pressure roller 3*b* may optionally have a cooler.

The cooling mechanism 4 has a cooling fan 4*a* which lies at the inner peripheral surface side of the cooling and separating belt 2, is disposed in a region between the heating roller 3*a* and the separating roller 5*a*, around which the cooling and separating belt 2 is wound, without being in contact with the cooling and separating belt 2, and supplies air for cooling toward the region; and a cooling mechanism including two cooling fans 4*b* and 4*c* which lie at the circumference surface side of the cooling and separating belt 2, is disposed in a region between the pressure roller 3*b* and a conveyance auxiliary roller 5*b* without being in contact with the cooling and separating belt 2, and supplies air for cooling toward the region, and a heat sink 4*d* connected to each of the cooling fans 4*b* and 4*c*. From the configuration of the cooling mechanism 4, a cooling region Co is formed in a region which lies at the outer peripheral surface side of the cooling and separating belt 2 and between the heating roller 3*a* and the separating roller 5*a*.

The separating mechanism 5 is configured by a separating roller 5*a*; a bend part of the cooling and separating belt 2 which largely changes the circulating and traveling direction of the cooling and separating belt 2 and is formed by disposing the heating roller 3*a* and the supporting roller 6 in a positional relationship where the separating roller 5*a* serves as a fulcrum and an acute angle is made therebetween; and a conveyance auxiliary roller 5*b* which is disposed opposite to the separating roller 5*a* at a distance which is equal to or slightly longer than the thickness of an object to be processed W which has a toner layer on an image support P.

The roller diameter of the separating roller 5*a* may be preferably a diameter in which the curvature thereof is controlled according to the rigidity of the image support P and the object to be processed W is separated from the cooling and separating belt 2 at the separating mechanism 5. For example, the roller diameter ϕ is preferably 10 to 40 mm.

The front surface of the cooling and separating belt 2 as described above is formed of the specific cured resin. Therefore, the balance of elasticity derived from the urethane (meth)acrylate (A) and hardness derived from the polyfunctional monomer (B) is excellent and the cooling and separating belt 2 has high toughness. Thus, the wear resistance to stresses due to friction and separation can be obtained. Even when the belt is used for extended periods, the low energy property derived from the fluorine-modified acrylate (C) is not largely impaired. Accordingly, the initial surface property can be maintained over a long period of time.

Image Formation Processing:

The image formation processing performed in the image forming device shown in FIG. 1 will be described in detail. In the clear toner image forming section 20H and the color toner image forming sections 20Y, 20M, 20C, and 20Bk of the image forming device shown in FIG. 1, the photoreceptors 11H, 11Y, 11M, 11C, and 11Bk are first charged by the charging units 23H, 23Y, 23M, 23C, and 23Bk, and then exposed by the exposure units 22H, 22Y, 22M, 22C, and 22Bk to form electrostatic latent images. The electrostatic latent images are developed with respective toners in the development units 21H, 21Y, 21M, 21C, and 21Bk to form a clear toner image and respective color toner images. The clear toner image and the respective color toner images are successively transferred to an intermediate transfer belt 16 by the primary transfer rollers 13H, 13Y, 13M, 13C, and 13Bk. These toner images are overlaid on the intermediate transfer belt 16 to form toner powder layers made of unfixed toners. Further, an image support P contained in a paper feeding cassette 41 is fed by a paper feeding conveyor 42, and conveyed by a plurality of paper feeding rollers 44*a*, 44*b*, 44*c*, and 44*d* and a resist roller 46. In a secondary transfer roller 13A, the toner powder layers on the intermediate transfer belt 16 are collectively transferred to the image support P. After then, the toner powder layers transferred to the image support P are fixed by heating and pressure in a fixing device 26 to form a toner layer.

The toner powder layers transferred to the image support P form an image in which a black toner image, a cyan toner image, a magenta toner image, a yellow toner image, and a clear toner image are overlaid in this order from the image support P side on the image support P. The toner layer obtained by fixing in the fixing device 26 has a top layer made of the clear toner.

After transfer of the clear toner image or each color toner image to the intermediate transfer belt 16, residual toners are removed by cleaning units 25H, 25Y, 25M, 25C, and 25Bk from the photoreceptors 11H, 11Y, 11M, 11C, and 11Bk. The photoreceptors 11H, 11Y, 11M, 11C, and 11Bk are then used in the formation of the clear toner image or each color toner image in the next process.

On the other hand, after transfer of the clear toner image and each color toner image to the image support P by the secondary transfer roller 13A, residual toners on the intermediate transfer belt 16 are removed by the cleaning unit 12. The intermediate transfer belt 16 is then used in the intermediate transfer of the clear toner image and each color toner image in the next process.

Glossing Processing:

The object to be processed W in which a toner layer is formed on an image support P after the image formation processing as described above is subjected to glossing processing.

In other words, the object to be processed W is sandwiched and conveyed by the heating roller 3*a* and the pressure roller 3*b* in the gloss nip portion N while the toner layer of the object W is in contact with the smooth face of the cooling and separating belt 2. In the gloss nip portion N, the toner layer is melted by heating, and simultaneously fused by pressure (heating and pressure step). Thus, a layer having a uniform thickness is formed similarly to the smooth face of the outer peripheral surface of the cooling and separating belt 2.

By the fusion, the object to be processed W is brought in close contact with the outer peripheral surface of the cooling and separating belt 2. The object to be processed W is moved to a cooling region Co when the cooling and separating belt 2 is circulated and traveled in an arrow direction.

The object to be processed W is forcibly cooled by air supplied by the cooling fans 4*a* to 4*c* while passing through the cooling mechanism 4. Thus, solidification of the toner layer is promoted to smooth the surface of the toner layer. As a result, a glossy toner image layer is formed (cooling step).

The object to be processed W conveyed to the separating mechanism 5 reaches the bend part of the cooling and separating belt 2 while the back surface is held in contact with the conveyance auxiliary roller 5*b*. When the circulating and traveling direction of the cooling and separating belt 2 is largely changed in the bend part, the object to be processed W is separated from the cooling and separating belt 2 by the rigidity of the image support P constituting the object to be processed W. The center of gravity of the object to be processed W is shifted to the conveyance auxiliary roller 5*b*, and the object to be processed W is gradually separated from the cooling and separating belt 2. Thus, a printed product having a glossy toner image layer on the image support P is obtained (separating step). The linear velocity during separation is preferably 20 to 200 mm/sec, more preferably 20 to 100 mm/sec.

In the cooling step, although the object to be processed W is cooled depending on the thermal property of the toner constituting a toner layer, the cooling is continued until the cooling temperature becomes, for example, 30 to 90° C., preferably 40 to 60° C.

The cooling temperature used herein is the surface temperature of a surface opposite to the smooth face of the cooling and separating belt 2 which is in contact with the toner layer during separation. Specifically, the surface temperature of the surface of the cooling and separating belt 2 in the cooling region Co is measured with an infrared radiation thermometer "IR0510" (manufactured by Konica Minolta Optics, Inc.). For example, the cooling temperature is the surface temperature at a position 5 to 10 cm before the position of separation by the separating roller 5*a*.

The image forming device shown in FIG. 1 is equipped with the fixing device 26 and the glossing device 1. By the image forming device, a high glossy image can be reliably formed. In other words, the image support P having a toner powder layer transferred by the intermediate transfer belt 16 is heated and pressurized by the fixing device 26, and as a result toners are melted. Thus, toners are fixed on the image support P to form a toner layer. The image support P having the toner layer formed by the fixing device 26 is heated and pressurized by the glossing device 1, and as a result the toner layer is melted again to smooth the surface of the toner layer. Thus, a high glossy image can be reliably formed. Therefore, the image forming device is preferable from the viewpoint of formation of a high glossy printed product.

In the present invention, an image forming device is not limited to the aspect of the image forming device shown in FIG. 1. For example, an image forming device equipped with only the glossing device 1 without a fixing device may be adopted. In such an image forming device, the heating and conveyance conditions of the glossing device 1 are adjusted so that the toner powder layer on the image support P is properly heated and pressurized. Thus, a toner is not required to be fixed first, but a glossy image layer can be directly formed. According to the image forming device having such a configuration, a high glossy image can be rapidly formed since processing by a fixing device is not necessary. Further, the production of compact image forming device is expected.

Developer:

A developer used in the image formation may be a one-component developer containing a magnetic or non-magnetic toner or a two-component developer containing a toner and a carrier.

A toner constituting the developer is not particularly limited, and various known developers can be used. For example, a polymerized toner obtained by the polymerization technique and having a median diameter by volume of 3 to 9 μm is preferably used. The use of the polymerized toner achieves high resolution in the formed image and a stable image density, and very largely suppresses the occurrence of image fogging.

A carrier in a two-component developer is not particularly limited, and various known carries can be used. For example, a ferrite carrier made of magnetic particles having a median diameter by volume of 30 to 65 μm and a magnetization amount of 20 to 70 emu/g is preferable. If a carrier having a median diameter by volume of less than 30 μm is used, carrier-beads carry over may occur, resulting in a white spot image. If a carrier having a median diameter by volume of more than 65 μm is used, an image having a uniform image density may not be formed.

Image Support:

Examples of the image support P used in the image formation may include, but not limited to, plain paper including thin paper and thin paper, wood-free paper, coated printer paper including art paper and coated paper, commercially available Japanese paper and postcard paper, plastic film for OHP, and cloth.

The embodiments of the present invention are specifically described above. However, the embodiments of the present invention should not be construed to be limited to the examples described above. Various modifications may be made in the invention.

For example, the glossing device of the present invention may be provided separately from an image forming device which performs steps until a toner layer is supported on an image support.

EXAMPLES

Hereinafter, Examples of the present invention will be specifically described, but the present invention is not limited to these Examples.

Production Example 1 of Cooling and Separating Belt

(1) Production of Substrate of Endless Belt

To a solution of polyamide acid in N-methyl-2-pyrrolidone (NMP) which contained 3,3',4,4'-biphenyltetracarboxylic acid dianhydride (BPDA) and p-phenylenediamine (PDA) ("U-Varnish-S," solid content: 18% by mass, manufactured by UBE INDUSTRIES, LTD.), dried carbon black after oxidation, "SPECIAL BLACK4" (manufactured by Degussa, pH: 3.0, volatile content: 14.0%), was added so that the content was 23 parts by mass per 100 parts by mass of a polyimide-based resin solid content. The mixture was divided into two portions, the two portions were collided with each other at a pressure 200 MPa and a minimal area of 1.4 $mm^2$ with an impact disperser "Geanus PY" (manufactured by Geanus), and then the mixture was divided again into two portions. This operation was repeated five times. Thus, the mixture was mixed to obtain a polyamide acid solution containing carbon black.

The polyamide acid solution containing carbon black was applied to the inner peripheral surface of a cylindrical mold through a dispenser so as to have a thickness of 0.5 mm. The cylindrical mold was rotated at 1,500 rpm for 15 minutes to obtain a development layer. The outside of the mold was exposed to hot air at 60° C. for 30 minutes while the mold was rotated at 250 rpm, and then the mold was heated at 150° C. for 60 minutes. The temperature was then increased to 360° C. at a temperature increasing rate of 2° C./min. The mold was further heated at 360° C. for 30 minutes to remove the solvent and water due to dehydration and cyclization, and to complete imide conversion reaction. After then, the temperature was cooled to room temperature, and the development layer was separated from the cylindrical mold to obtain an endless belt-shaped substrate having a thickness of 0.1 mm.

(2) Preparation of Coating Solution for Formation of Surface Layer 63 parts by mass of (A) component: urethane acrylate "U-6LPA" (manufactured by Shin Nakamura Chemical Co., Ltd.), 27 parts by mass of (B) component: dipentaerythritol hexaacrylate (DPHA), 10 parts by mass of (C) component: fluorine-modified acrylate "MEGAFAC RS-72-K" (manufactured by DIC Corporation), and 5 parts by mass of (D) component: 1-hydroxycyclohexyl phenyl ketone were dissolved in a solvent, propylene glycol monomethyl ether acetate (PMA), so that the solid content was 10% by mass. Thereby, a coating solution [1] for formation of a surface layer was prepared.

(3) Formation of Surface Layer

The coating solution [1] for formation of a surface layer was applied to the outer peripheral surface of the endless belt substrate with a coating device using an immersion coating method under the following coating conditions so as to obtain a coating film having a dried film thickness of 5 μm. The coating film was irradiated with ultraviolet light as an active energy ray under the following irradiation conditions and then cured to form a surface layer. Thus, a cooling and separating belt [1] was obtained. In the irradiation with ultraviolet light, a light source was fixed and the endless belt-shaped substrate was rotated at a peripheral velocity of 60 mm/s.

—Coating Conditions—

Amount of supplied coating solution: 1 L/min

Withdrawal velocity: 4.5 mm/min

—Conditions of Irradiation with Ultraviolet Light—

Type of light source: high pressure mercury lamp "H04-L41" (manufactured by EYE GRAPHICS CO., LTD.)

Distance between irradiation hole and surface of coating film: 100 mm

Dose: 1 J/cm$^2$

Irradiation time (time of rotating substrate): 240 seconds

Production Examples 2 to 7 of Cooling and Separating Belt

Cooling and separating belts [2] to [7] were produced in the same manner as in the cooling and separating belt of Production Example 1 except that each coating solution for formation of a surface layer was prepared in accordance with each composition shown in Table 1 in the step of preparing a coating solution for formation of a surface layer and the respective coating solutions were used in the step of forming a surface layer.

Evaluation 1: Image Offset:

Titanium oxide fine particles (abrasive) were put on the surface of the edge of a rubber blade, and the blade was disposed with respect to each of the cooling and separating belts [1] to [7] obtained. By a frictional abrasion processing in which the cooling and separating belts were rotated and driven for an appropriate time, stress was applied to the surfaces of the cooling and separating belts. After then, each of the cooling and separating belts was installed in a glossing device shown in FIG. 2, and an image was subjected to glossing processing. The surface of the cooling and separating belt after use was observed, and adhesion of toners was evaluated in accordance with the following criteria for evaluation. The results are shown in Table 1. When the criteria for evaluation is A, the belt is acceptable.

Criteria for Evaluation

A: Even when stress is applied for 1,000 seconds, toners do not adhere.

B: When stress is applied for 500 seconds, toners adhere.

C: When stress is applied for 200 seconds, toners adhere.

Evaluation 2: Film Strength:

Titanium oxide fine particles (abrasive) were put on the surface of the edge of a rubber blade, and the blade was disposed with respect to each of the cooling and separating belts [1] to [7] obtained. By a frictional abrasion processing in which the cooling and separating belts were rotated and driven for an appropriate time, stress was applied to the surfaces of the cooling and separating belts. An image was formed using each of the cooling and separating belts as a fixing belt. The presence or absence of image defect caused by crack on the surface layer due to stress was observed in the obtained image. Thus, film strength was evaluated. The results are shown in Table 1. When the criteria for evaluation is A, the belt is acceptable.

Criteria for Evaluation

A: Even when stress is applied for 3,000 seconds or more, image defect caused by crack is not observed.

B: When stress is applied for 3,000 seconds, image defect caused by crack is observed.

C: When stress is applied for less than 3,000 seconds, image defect caused by crack is observed.

TABLE 1

| | COOLING AND SEPARATING BELT No. | CURED RESIN (A) COMPONENT (PART BY MASS) | CURED RESIN (B) COMPONENT (PART BY MASS) | CURED RESIN (C) COMPONENT (PART BY MASS) | EVALUATION RESULT IMAGE OFFSET | EVALUATION RESULT FILM STRENGTH |
|---|---|---|---|---|---|---|
| EXAMPLE 1 | 1 | 27 | 63 | 10 | A | A |
| EXAMPLE 2 | 2 | 18 | 42 | 40 | A | A |
| COMPARATIVE EXAMPLE 1 | 3 | 20 | 20 | 60 | B | B |
| COMPARATIVE EXAMPLE 2 | 4 | 90 | 5 | 5 | B | A |
| COMPARATIVE EXAMPLE 3 | 5 | 5 | 90 | 5 | C | C |
| COMPARATIVE EXAMPLE 4 | 6 | 80 | 10 | 10 | B | B |
| COMPARATIVE EXAMPLE 5 | 7 | 10 | 80 | 10 | B | C |

REFERENCE SIGNS LIST

1 glossing device
2 cooling and separating belt
3*a* heating roller
3*b* pressure roller
3*c* heat source
4 cooling mechanism
4*a*, 4*b*, 4*c* cooling fan
4*d* heat sink
5 separating mechanism
5*a* separating roller
5*b* conveyance auxiliary roller
6 supporting roller
10 intermediate transfer section
11H, 11Y, 11M, 11C, 11Bk photoreceptor
12 cleaning unit
13H, 13Y, 13M, 13C, 13Bk primary transfer roller
13A secondary transfer roller
16 intermediate transfer belt
16*a* to 16*d* supporting roller
20H clear toner image forming section
20Y, 20M, 20C, 20Bk color toner image forming section
21H, 21Y, 21M, 21C, 21Bk development unit
22H, 22Y, 22M, 22C, 22Bk exposing unit
23H, 23Y, 23M, 23C, 23Bk charging unit
25H, 25Y, 25M, 25C, 25Bk cleaning unit
26 fixing device
27, 28 heating and pressure roller
41 paper feeding cassette
42 paper feeding conveyor
44*a*, 44*b*, 44*c*, 44*d* paper feeding roller
46 resist roller
N gloss nip portion
P image support
W object to be processed

The invention claimed is:

1. A glossing device comprising: an endless cooling and separating belt which is wound around a heating roller and a supporting roller; a pressure roller disposed so as to press the cooling and separating belt onto the heating roller to form a nip portion between the cooling and separating belt and the pressure roller; and a cooling mechanism disposed at a downstream of the heating roller in a traveling direction of the cooling and separating belt, wherein the cooling and separating belt has a front surface formed of a cured resin containing a structural unit derived from urethane(meth)acrylate (A) having three or more (meth) acryloyloxy groups per molecule, a structural unit derived from a polyfunctional monomer (B) having three or more (meth)acryloyloxy groups per molecule and no urethane bond, and a structural unit derived from fluorine-modified acrylate (C), and the cured resin contains 18 to 63% by mass of the structural unit derived from the urethane(meth)acrylate (A), 18 to 63% by mass of the structural unit derived from the polyfunctional monomer (B), and 10 to 40% by mass of the structural unit derived from the fluorine-modified acrylate (C).

2. The glossing device according to claim 1, wherein the urethane(meth)acrylate (A) is obtained by reaction of a polyol compound (a1) having two or more hydroxyl groups per molecule, a polyisocyanate compound (a2), and an acrylate compound (a3) having a hydroxyl group and an acryloyloxy group per molecule.

3. The glossing device according to claim 2, wherein the polyol compound (a1) is a cyclic alcohol.

4. The glossing device according to claim 1, wherein the fluorine-modified acrylate (C) has a number average molecular weight of 10,000 or higher.

5. The glossing device according to claim 1, wherein the cooling and separating belt has a surface layer formed of the cured resin on a substrate of endless belt formed of a polyimide resin.

* * * * *